United States Patent [19]

Vydrin et al.

[11] 4,157,025

[45] Jun. 5, 1979

[54] METHOD AND MILL FOR ROLLING METAL BILLETS

[76] Inventors: Vladimir N. Vydrin, ulitsa Timiryazeva, 28, kv. 27; Evgeny N. Berezin, ulitsa Engelsa, 28, kv. 72; Vladimir G. Dremin, ulitsa Beloretskaya, 70, kv. 22, all of Chelyabinsk; Oleg I. Tischenko, ulitsa Lenina, 6, kv. 3, Temirtau; Gennady Z. Serebrennikov, ulitsa Rumyantseva, 27, kv. 55, Chelyabinsk, all of U.S.S.R.

[21] Appl. No.: 857,509

[22] Filed: Dec. 5, 1977

[51] Int. Cl.[2] ..... B21B 21/00

[52] U.S. Cl. ..... 72/189; 72/214

[58] Field of Search ..... 72/189, 214, 240, 402, 72/406

[56] References Cited

U.S. PATENT DOCUMENTS

| | | | |
|---|---|---|---|
| 396,361 | 1/1889 | Johnson | 72/189 |
| 3,114,276 | 12/1963 | Uebing et al. | 72/406 |
| 3,488,680 | 1/1970 | Elsasser | 72/214 |
| 3,911,720 | 10/1975 | Kocks | 72/406 |

*Primary Examiner*—Lowell A. Larson

*Attorney, Agent, or Firm*—Fleit & Jacobson

[57] ABSTRACT

A method of rolling metal billets in a single pass comprises the steps of reducing a billet by workrolls and alternating each reduction cycle of the billet being worked with axial feed thereof through a step of rolling. As the billet is worked by the workrolls a transitional section is formed thereon as a deformation cone having a length along the axis of the billet substantially greater than the corresponding length of the deformation zone induced in the billet by each workroll at each given moment. The mill for carrying out this method comprises a frame having guides running in parallel with the axis of the billet being worked and mounting a roll housing geared to the mill drive to reciprocate the roll housing inside said guides in the course of rolling. The roll housing accommodates at least four variable-radius workrolls having their geometrical axes of rotation extended in one plane perpendicular to the axis of the billet being worked, the rotation of the workrolls about said axes being effected in the course of rolling positively and in synchronism with the reciprocations of the housing. The mill is also provided with a feeder for axially feeding the billet to the workrolls, mounted on the frame on the side of the billet entry to the workrolls and geared to the mill drive.

6 Claims, 6 Drawing Figures

METHOD AND MILL FOR ROLLING METAL BILLETS

The present invention relates to metal working, and more specifically, to a method of and a mill for rolling metal stock in a single pass so as to obtain rolled products from ferrous and non-ferrous metals and alloys.

This invention can be used to advantage in the manufacture of rolling billets of low-ductility and hard-to-deform metals and alloys. Castings, powder mouldings, predeformed billets, etc., may be used as starting stock.

For example, there are known in the art methods for rolling metal billets in a single pass, comprising the steps of reducing a billet by workrolls during which a transitional section is formed thereon as a deformation cone having the length axially of the billet substantially greater than the corresponding length of the deformation zone induced in the billet by each workroll at each given moment, and alternating the reduction with axial feed of the billet being worked through one step of rolling.

There are also widely known mills for carrying out the above-described rolling method, comprising a support frame having guides running axially along the billet being rolled and in which there is mounted a roll housing geared to a mill drive to reciprocate the stand inside said guides in the course of rolling.

A pair of variable-section workrolls are mounted in the roll housing having their axes arranged symmetrically with respect to the axis of the billet and run in a plane drawn at right angle to the billet axis.

Each mill is provided with a feeder for axially feeding the billet, mounted on the support frame on the side where the billet enters the workrolls and geared to the mill drive.

Such mills are normally used for rolling hollow tubular billets which are mounted on mandrels, each billet being reduced as the workrolls are displaced along the billet axis with concurrent rotation of the workrolls about their axes and as the working faces thereof coming in contact with the billet approach one another. The reduction of the billet is alternated with its axial feed through one pass.

The main disadvantage of the prior art method of pendulum rolling and of two-high mills for carrying out this method is that deformation of metal of the billet being rolled follows the pattern of uniaxial compression, thus lowering the metal ductility.

In addition, the reduction in such mills is effected non-uniformly over the billet periphery, which also adversely affects workability of the billet material.

Another disadvantage of the prior art two-high mills is a great difference in speeds in various points of passes of the workrolls, which impairs the elongation capacity of the passes and beings about their rapid wear.

The above-mentioned disadvantages become still more pronounced in rolling solid billets of low-ductility metals and alloys making the prior-art two-high mills impractical in this case.

It should be borne in mind that the rolling of the end portion of a hollow billet in such mills in only possible by inserting a mandrel therein; working of solid billets is practically impossible to effect in such mills.

There are also known in the art mills in which reduction is effected by two pairs of un-driven workrolls, each pair moves as a unit displaced in time phase with respect to each other.

In such mills, the shaft of each workroll is journaled in lugs secured to an elongated member, one end of which surrounds and journals an eccentric rotatable through a drive, the other end is pivotally connected to a link, which is pivotally connected to a projection of the mill frame. The eccentrics adapted to impart motion to the elongated members of each pair of workrolls are set out of phase in the direction of the pass.

The motion of the eccentrics causes each workroll to approach passline in a curved path and retreat from it in a second curved path.

The center line of any of the workrolls thus moves in a closed curved path. As workrolls are mounted for free rotation and are not driven by the mill motor, they are free to rotate about their axes and restrained to permit rotation through an arc of less than 360° when they make contact with the work in the pass, in the direction determined by the friction of the workroll with the material being reduced and motion imparted to the workpiece, by the mill feeding and withdrawing means. During the return movement of the workrolls axes along the curved path, the workrolls are brought back (e.g. by means of springs) to initial position.

In such mills, as compared to the above-described two-high rolling mills, the difference in speeds over the perimeter of the pass of the workrolls decreases to thereby result in less rapid wear of the workrolls. Thus, the reduction of the billet over the perimeter of the cross-section is effected more uniformly than in the two-high mills.

However, the main disadvantage of the two-high mills, i.e. reduction of the billet in the deformation zone—according to the axial compression pattern, is also inherent in this type of mill.

Among the disadvantages of the prior art mills having two pairs of workrolls spaced apart along the pass line is that such displacement of the workrolls, as shown by the study of metal deformation, causes considerable non-uniformity of deformation over the cross-section of the billet, adversely affecting quality of the billets, especially of those produced from metals and alloys having low ductility.

Other disadvantages of the prior-art rolling method and mills should be mentioned as well.

Thus, substantial speed of the billet metal decreases its elongation. The reduction of a billet by undriven rolls results in the development of tensile force therein. Curvilinear configuration of the travelling path of the driven roll results in undulations formed on the billet surface after rolling.

The disadvantage also resides in that the eccentrics are driven through bevel gears which have relatively short service life as they operate in direct proximity to hot metal and under heavy loads. The same applies to the reliability of spring bias devices for rotation of the workrolls during the idle movement thereof.

It is an object of the invention to provide a method of and a mill for rolling of metal billets in a single pass which permit the billet metal workability to be improved in the zone of its deformation during reduction, thereby enhancing quality of the finished products especially of those from low-ductility metals and alloys.

Another object of the invention is to provide a method of and a mill for rolling of metal billets, which enable the billet spread to be decreased and its elongation increased in a single pass, thus enhancing productivity of the mill and reducing power inputs required for deformation.

Still another object of the invention is to improve reliability of the mill components which absorb the rolling force and transmit torque to the workrolls of the mill.

It is also an object of the invention to eliminate the formation of bulges, barbs and acute edges on the billet being rolled.

It is yet another object of the invention to eliminate axial forces in the billet in the course of its rolling.

These and other objects are accomplished by provision of a method of rolling of metal billets in a single pass, comprising the steps of reducing a billet by workrolls during which a transitional section is formed thereupon in the form of a deformation cone having a length along the axis of the billet substantially greater than that of the corresponding length of the deformation zone formed in the billet by each workroll at each given moment, and alternating the reduction with axial feed of the billet being rolled in a single pass, wherein, according to the invention, the billet is reduced uniformly substantially over the entire periphery thereof in such a manner that deformation zones induced by all workrolls are restricted throughout the reduction process within a length of the deformation zone induced by one workroll.

The term deformation zone is used herein to imply the deformation induced in the billet being rolled by one workroll at each given moment.

This method will enhance workability of the billet metal since the deformation zones induced by all the workrolls are restricted within the same length of the billet due to the effect of biaxial compression.

It has been experimentally found that this feature does away with material non-uniformity in the deformation occurring across the billet, with the deformation zones being spaced axially apart therealong, thereby permitting shear deformation to be reduced and discontinuities of metal to be eliminated.

In addition, bringing together the deformation zones axially along the billet enables the metal bulging to be decreased thereby promoting the billet elongation in a single pass.

It is advisable that in the course of axial feeding of the billet being worked the latter be alternately tilted in opposite directions through a half the angle between two planes running through the axis of the billet, of which one plane is perpendicular to the axis of one of the workrolls and the other one, to the axis of the adjacent workroll.

Tilting the billet being worked during its axial feed also provides for smooth surface of the billet emerging from the workrolls without fins and bulges.

In addition to improving the billet quality, the tilting operation also contributes to more uniform deformation.

Alternating the direction of the billet tilting during its axial feed prevents twisting of the billet.

At the end of each reduction cycle, the billet being worked is preferably sized so as to preclude undulations of its surface.

The above objects are also accomplished by the provision of a mill for carrying out the method of rolling metal billets in a single step according to the invention, comprising a support frame having guides running in parallel with the axis of the billet being worked and mounting a roll housing geared to the mill drive adapted to reciprocate the roll housing inside said guides in the course of rolling, said housing carrying variable-radius workrolls disposed symmetrically with respect to the axis of the billet, a feeder device intended for the billet axial feed, mounted on the support frame on the side of the billet entrance to the workrolls and geared the mill drive. According to the invention, roll housing has at least four workrolls having their geometrical axes of rotation extended in one plane perpendicular to the axis of the billet, the rotation of the workrolls about said axis being effected during rolling positively and in synchronism with the reciprocation of the roll housing.

Such mill construction permits the deformation zones induced in the billet being rolled by all workrolls to be restricted within the deformation zone induced by one workroll at each given moment, whereby the billet deformation follows the pattern of biaxial compression, resulting in better workability of the billet metal and, as a consequence, in improved quality of the finished product.

It is noted that positive rotation of the workrolls improves their operating conditions and enables a preset compressive force (thrust) to be applied axially along the billet being worked whereas the use of undriven workrolls for rolling results in the tensile axial force effecting the billet. The relative position of the workrolls and the billet being worked also becomes very definite at each moment of rolling. In particular, this enables a given shape of the workroll working face to be used at the sizing section.

Each workroll is preferably shaped as a sector of a circle in the plane perpendicular to the geometrical axis of its rotation, the axis of the sector being disposed eccentrically with respect to said geometrical axis of rotation of the workroll so as to have a curvilinear portion formed on its surface with variable radius of curvature; and disposed on the side of the billet emergence from the workrolls and mating with the curvilinear portion is the sizing section formed in such a manner that all generatrixes of its surface run in parallel with the axis of the billet being worked at the end of the working movement of the workroll, the length of the sizing section axially of the billet being determined from the formula $l \geqq S \cdot \lambda$ wherein S is the billet axial feed, through one step and $\lambda$ is the elongation of the billet in a single pass.

Such construction of the workrolls enables the roll housing dimensions to be reduced, thereby making the mill more compact as a whole.

In addition, the provision of the sizing sections of the workrolls defining final dimensions and cross-sectional shape of the billet also eliminates undulation of the surface of the billet being worked and, in combination with tilting of the billet, permits smoother surface without fins and bulges to be obtained.

To make the sized sections of the billet overlap one another, the length of the sizing section of the workroll axially along the billet should be greater than that of the billet at the emergence from the workrolls in a single pass, this length depending on the axial feed of the billet and its elongation.

The construction of the workrolls according to the invention also makes it possible to decrease their angle of rotation and shorten the distance of the roll housing travel so that the billet axial feed is reduced through one travel of the rolling housing, thus considerably improving quality of the billet deformed metal without lowering the productivity of the mill as a whole. The billet metal after such rolling is dense and fine-grained, its mechanical properties and durability being improved as well.

All the above-said becomes especially important in rolling billets of low-ductility and hard-to-deform metals and alloys.

The part of the workroll formed with the curvilinear section and the sizing section is preferably made removable and comprises a replaceable insert of a wear-resistant refractory alloy, and the other part of the workroll is provided with an appropriate recess and a threaded hole for securing said insert thereof.

The inserts prolong the service life of the workrolls.

In accordance with further embodiment of the invention the positive rotation of each workroll about its axis is effected by means of a rocking bar having one end pivotally connected to a workroll and the other end, to a support member common for all rocking bars and secured to a frame on the side of the billet emergence from the workrolls.

Rotation of the workrolls by means of the rocking bars improves reliability of the workroll drive operable under heavy loads and at high temperatures as compared to the workroll drive e.g. in multiroll mills and in cold rolling pipe mills where gear transmissions are used for this purpose.

In addition, with such construction of the workroll drive, the pressure of the billet metal applied to the workrolls is not transmitted directly to components of the roll housing drive and is mainly absorbed by the rocking bars and workroll shafts.

Each rocking bar may be forked at one end thereof to thereby accommodate the corresponding workroll at the point of their articulation joint.

This construction makes the rocking bars stronger and more reliable under heavy loads imposed on the workrolls.

The support member is preferably formed of a hollow cylindrical casing mounted coaxially with the billet and having through holes fitted in the end walls thereof coaxially with the billet and receiving a guide member formed as a tube for the passage of the billet, axially movable and rotatable about its axis in the support member together with the billet by means of an auxiliary device for axially feeding and tilting the billet having a clamp for clamping the billet in the guide member and mounted in the openings of the guide member, a linkage gearing the outlet end of the guide member to the roll housing to cause the axial movement of the guide member and a pneumatic cylinder means having a cylinder pivotally connected to the support member with a piston rod thereof being pivotally connected to the guide member to cause its rotation.

The provision in the mill according to the invention of an auxiliary feeding and tilting device mounted behind the roll housing along the pass line and operating in synchronism with the device for axial feeding of the billet on the side of its entry to the workrolls enables the billet to be worked in a single pass throughout its length.

Such construction of the auxiliary device for axially feeding the billet and tilting it on the side of its emergence from the workrolls enables free passage of the billet through the guide member during reduction and ensures axial feed of the billet to be effectual concurrently with its tilting at the end of the roll housing idle movement. It is noted that the force transmitting connection of this device with the mill stand housing provides for reliable synchronization of its operation with the operation of the mill stand.

Each clamp for clamping a billet in the guide member may consist of two jaws mounted on either side of the billet being in coaxial guides fitted in the openings of the guide member, one jaw being rigidly secured to a piston rod of another pneumatic cylinder means externally mounted on the guide member, the other jaw being connected to an adjustment screw for adjusting the gap between the jaws.

Such clamp enables smooth application of a clamping force to the billet during its clamping.

The invention will now be described with reference to specific embodiments thereof illustrated in the accompanying drawings, in which:

FIG. 1 diagrammatically illustrates a method rolling metal billets in a single pass according to the invention;

The method according to the invention for rolling metal billets 1 in a single pass (FIG. 1) is based upon reduction of a billet by workrolls 2, and alternating the reduction with axial feed of the billet 1 being worked through a rolling step "S".

During intermittent reduction of the billet 1 a transitional section is formed thereon as a deformation cone "K" having a length "M" axially along the billet 1 substantially greater than the corresponding length "m" of the deformation zone induced in the billet 1 by each workroll 2 at each given moment.

Figure 2:
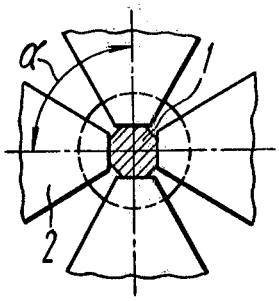
FIG. 2 is a cross-section taken on the plane II—II of FIG. 1.

According to the invention, the billet 1 being worked is reduced uniformly substantially over the entire periphery thereof, such as shown in FIG. 2, in such a manner that the deformation zones induced by all workrolls 2 at every given moment are located during the entire reduction cycle within the length "m" of the deformation zone induced by one workroll 2.

Therefore, at each given moment the deformation of the billet 1 is effected in accordance with the pattern of biaxial compression, thus improving ductility of the material of the billet 1 and, consequently its quality.

According to the invention, the billet 1 is alternately tilted in the course of its axial feed in opposite directions through a half the angle $\alpha$ (FIG. 2) between two planes drawn through the axis of the billet 1, one plane extending perpendicular to the axis "0" of rotation of one of the workrolls 2, the other plane running perpendicular to the workroll 2 adjacent thereto. In this embodiment, the angle $\alpha$ equals 90°, and the billet 1 is to be tilted through 45 deg.

At the end of each reducton step, the cross-section of the billet 1 is sized, which, in combination with the billet concurrent tilting, permits the billet 1 to be obtained with smooth and regular surface free of fins and bulges.

Other advantages of the method of rolling metal billets 1 in a single pass according to the invention will become apparent from the description of operation of a mill for carrying out this method.

Figure 3:
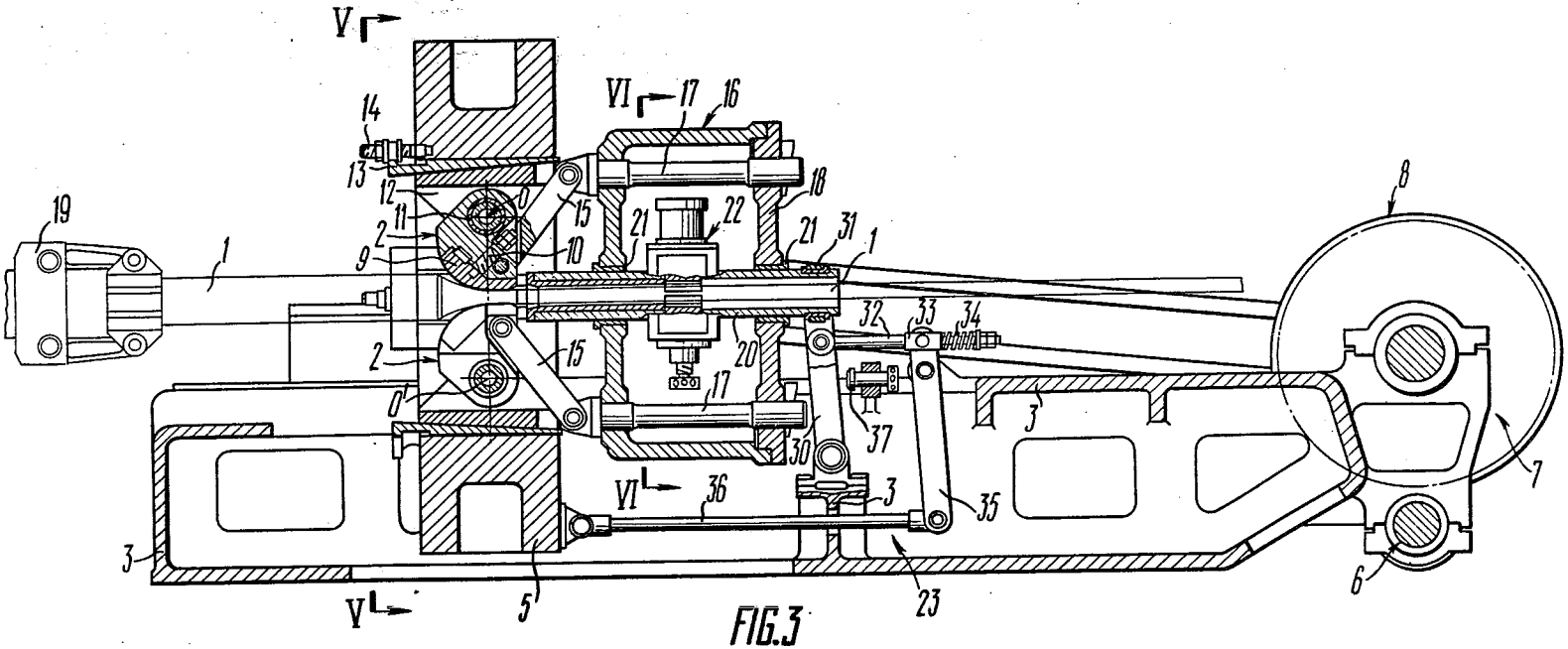
FIG. 3 is a general longitudinal section view of a mill for carrying out the method of rolling metal billets in a single pass according to the invention.

The mill according to the invention for carrying out the method of rolling billets in a single pass comprises a frame 3 (FIGS. 3 and 4) having guides 4 running in parallel with the axis of the billet 1 being worked and mounting a one-piece roll housing 5 geared to the mill drive, e.g. an electric motor 6, to reciprocate the roll housing inside the guides 4 of the frame 3 in the course of rolling.

The force transmitting connection of the roll housing 5 with the shaft of the electric motor 6, is effected in this particular case by means of a twin crank gear 7 and a reduction gear in the form of a twin spur gear transmission 8.

Figure 4:
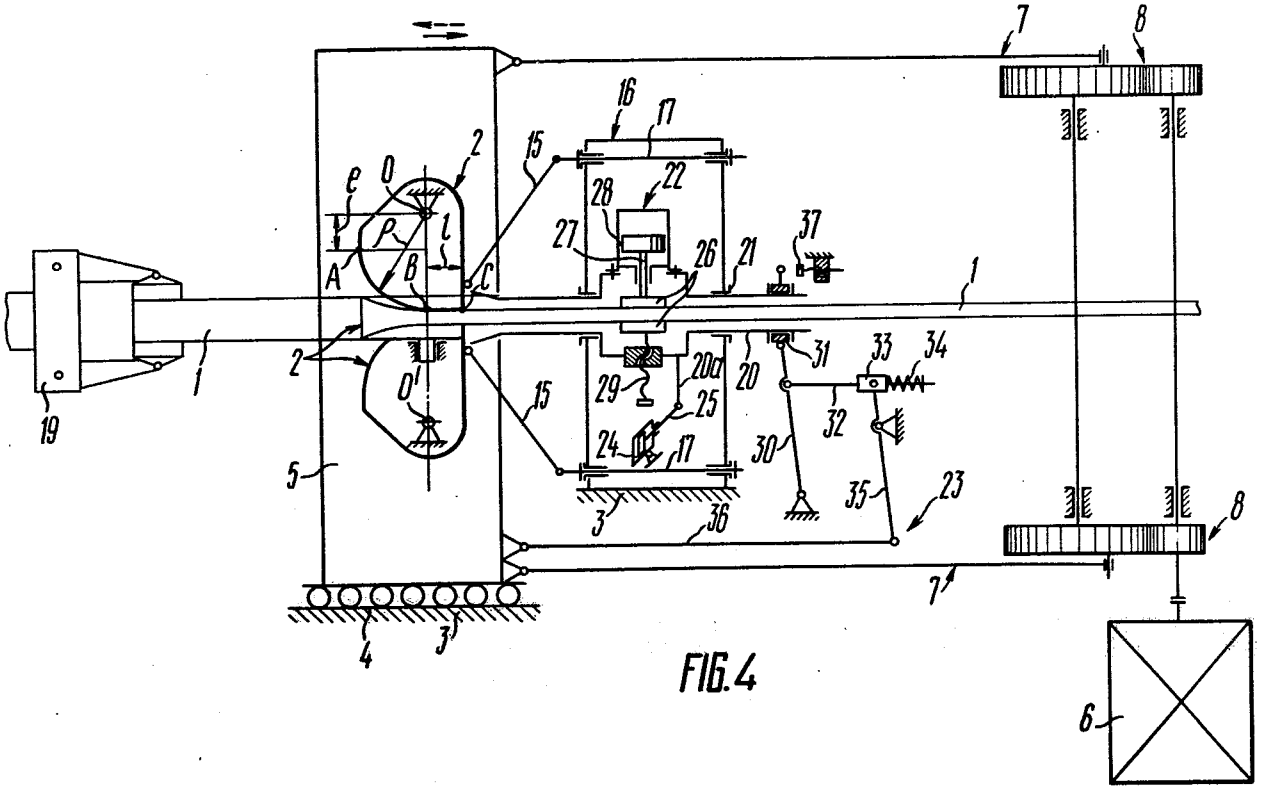
FIG. 4 shows a kinematic chain of the mill.
Figure 5:
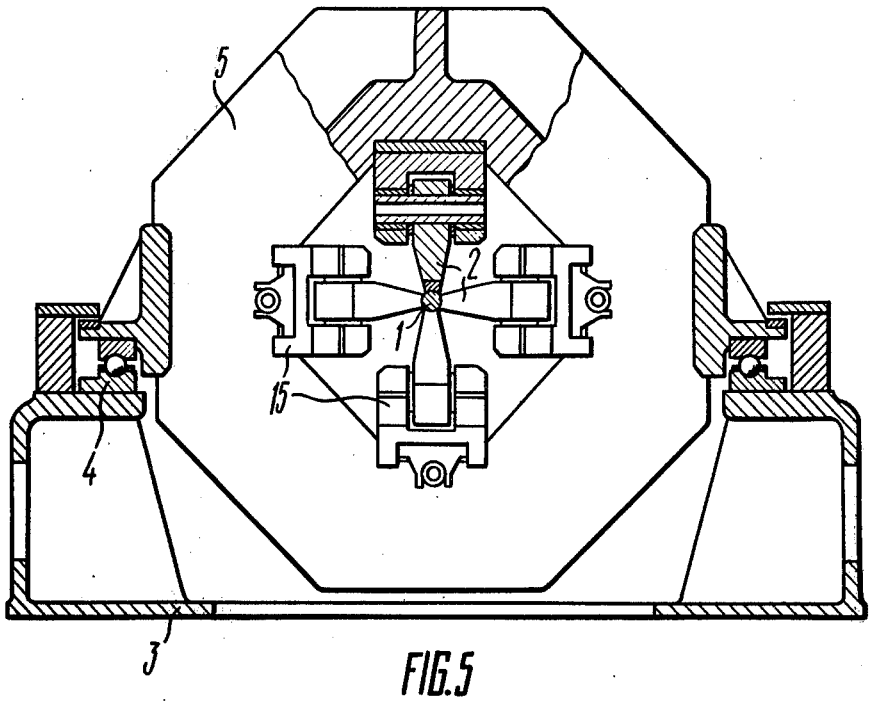
FIG. 5 is a cross-section taken on the plane V—V of FIG. 3 with partial axial section of one of the workrolls.

In an opening fitted centrally in the roll housing 5 there are mounted four workrolls 2 having their geometrical axes of rotation 0 and 0' (FIGS. 1 and 4) disposed according to the invention in one plane perpendicular to the axis of the billet 1. The workrolls 2 are arranged in pairs symmetrically with respect to the axis of the billet 1. In this mill, the axes 0 and 0' of rotation of one pair of the workrolls 2 extend substantially horizontally and the axes of the other pair extend substantially vertically such as shown in FIGS. 4 and 5.

Each workroll according to the invention is shaped in the plane perpendicular to the geometrical axis 0 of its rotation as a sector of a circle having its axis arranged with an eccentricity "e" (FIG. 4) with respect to the geometrical axis "0" of rotation of the workroll 2 so as to define on the workroll surface a curvilinear section "AB" variable radius of curvature $\rho$.

The section "AB" mates on the side of emergence of the billet 1 from the workrolls 2 with a sizing section "BC" generally formed in such a manner that all generatrixes of the surface thereof run in parallel with the axis of the billet 1 at the end of the working movement of the workroll 2. In this specific embodiment, where the billets 1 are octagonal in cross-section, the sizing section "BC" of the workroll 2 is flat.

The length l of the sizing section "BC" lengthwise of the billet 1 may be determined from the formula $l \geqq S \cdot \lambda$ wherein S is the axial feed of the billet 1 through one step, and $\lambda$ is the billet elongation.

The part of the workroll 2 having the curvilinear section "AB" and the sizing section "BC" (which define in combination the working surface of the workroll 2 in contact with the billet 1 being worked) is made removable in the form of a replaceable insert 9 (FIG. 3) of a wear resistant refractory alloy. The other part of the workroll 2 has an appropriate recess and a threaded hole for securing thereto the insert 9 by means of a bolt 10.

Shafts 11 of the workrolls 2 are supported by pads 12. The walls of the window of the roll housing 5 are formed with guides for wedges 13 cooperating with the pads 12 of the shafts 11 of the workrolls 2. By moving the wedges 13 in the guides of the housing 5 by means of adjustment screws 14, the gap between the shafts 11 of the workrolls 2 may be adjusted during re-adjustment of the mill to handle billets of different size.

The rotation of the workrolls 2 about their shafts 11 is effected according to the invention positively and in synchronism with the reciprocation of the roll housing 5 in the guides 4 of the mill frame 3.

For this purpose, each workroll 2 is pivotally connected by means of a rocking bar 15 (FIGS. 3, 4 and 5) to a support member 16 common for all rocking bars 15 and secured to the frame 3 on the side of emergence of the billet 1 from the workrolls 2 and formed as a hollow cylindrical casing mounted coaxially with the billet 1.

Each rocking bar 15 is forked at one end thereof such as shown in FIG. 5, to thereby embrace the corresponding workroll 2 at the point of their articulation joint.

At the other end, the rocking bar 15 is pivotally connected to the end of an arm 17 secured in holes fitted in the end faces of the support member 16. The outer end face of the support member 16 is formed as a removable cover plate 18 adapted to allow accommodation, inside the support member 16 of an auxiliary device for axially feeding and tilting the billet 1 according to the invention.

A feeder 19 for axially feeding the billet 1 is mounted on the mill frame 3 on the side of entry of the billet 1 to the workrolls 2. The feeder 19 may be of any appropriately known design, e.g. similar to that of a forging manipulator (its detailed description is not given herein), and is used for gripping the billet 1 at one end, as well as for axial feeding the billet and its tilting in synchronism with the reciprocation of the roll housing.

The end walls of the support member 16 are formed with holes coaxial with the billet 1, receiving a guide member 20 in the form of a tube for the passage of the billet 1 being worked. The guide member 20 is mounted in the support member 16 for axial movement and rotation about its axis together with the billet 1. For this purpose, the guide member 20 is journalled in bearings 21 fitted in the holes of the support member 16, and its axial displacement and rotation are effected by means of an auxiliary device for axially feeding and tilting the billet 1, which functions in synchronism with the reciprocations of the roll housing.

Figure 6:
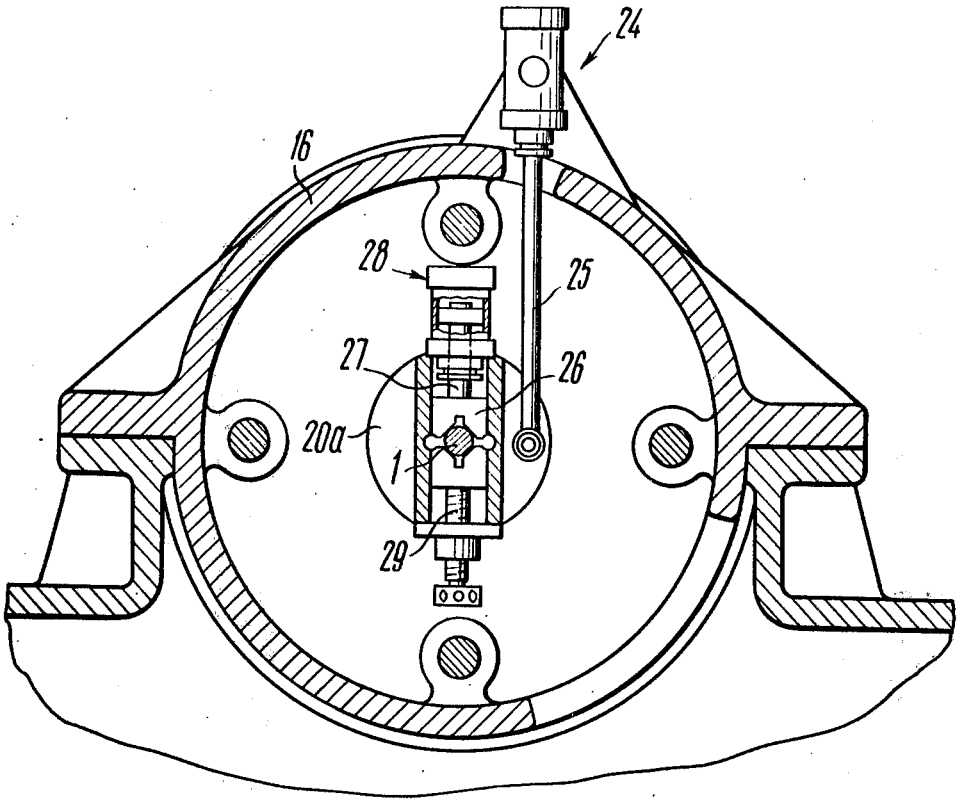
FIG. 6 is a cross-section taken on the plane VI—VI of FIG. 3.

This device comprises a clamp 22 for clamping the billet 1 in the guide member 20 mounted in openings of the guide member, a linkage 23 gearing the outlet end of the guide member 20 with the roll housing 5 for axially displacing the guide member 20 and a pneumatic cylinder means 24 (FIG. 6) having a cylinder pivotally connected to the shell of the support member 16, a piston rod 25 thereof being pivotally connected to the guide member 20 by means of a ring 20*a* secured thereto to cause rotation of the guide member 20.

The clamp 22 consists of two jaws 26 (FIGS. 4 and 6) mounted on either side of the billet 1 being worked in coaxial guides provided in the openings of the guide member 20. One jaw 26 is rigidly secured to a piston rod 27 of another pneumatic cylinder means 28 externally mounted on the guide member 20, and the other jaw 26 is rigidly connected to an adjustment screw 29 set in a threaded hole of the guide member 20 for adjusting the gap between the jaws 26 of the clamp 22 when the clamp is re-adjusted for a different outlet cross-section of the billet 1.

The linkage 23 comprises a rocking arm 30 (FIGS. 3 and 4) having one end pivotally connected to a ring 31 mounted at the outlet end of the guide member 20 intermediate two collars, the other end thereof being pivotally connected to the mill frame 3. The intermediate portion of the arm 30 is pivotally connected to the end of another arm 32 having a slider 33 which bears up through a spring 34 against a collar provided at the free end of this arm 32.

The slider 33 is pivotally connected to the end of a double-arm lever 35 having its pivot axle secured to the frame 3, and the other end of the lever is pivotally connected through a drawbar 36 to the roll housing 5.

Axial displacement of the guide member 20 (the billet 1 being fed) is adjusted by means of a movable stop 37 cooperating with the ring 31 mounted at the end of the guide member 20.

The mill according to the invention functions in the following manner.

When the electric motor 6 (FIG. 4) is energized, its output shaft is rotated to cause reciprocations of the roll housing 5 in the guides 4 of the mill frame 3 through the gear transmission 8 and crank gear 7.

At the same time, the workrolls 2 are also caused to oscillate about their shafts 11 under the action of the rocking bars 15.

The billet 1 being worked is advanced to the workrolls 2 by means of the feeder device 19 and is intermittently reduced by said workrolls.

The reduction of the billet 1 by the workrolls 2 is effected as follows (the reference is made to the stepwise rolling of the billet 1 having octagonal section chosen as an example).

Figure 1:
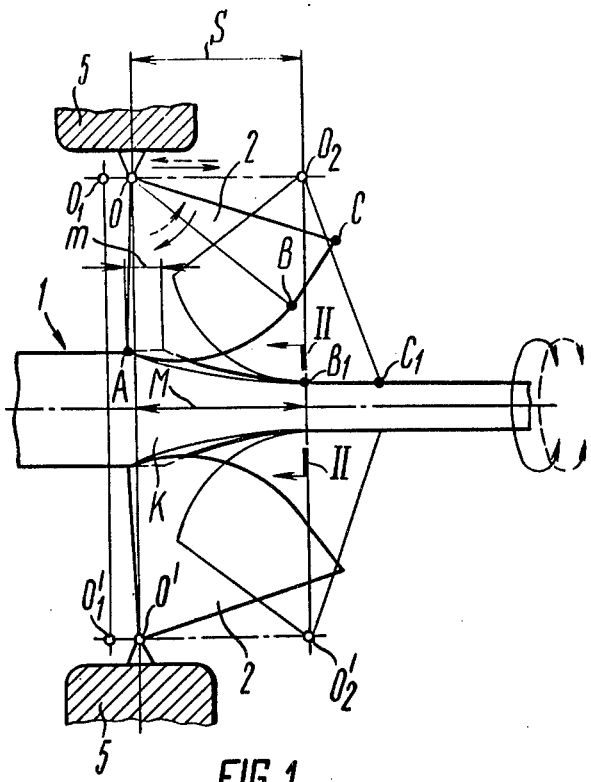

During the working movement of the roll housing 5 in the right-hand direction shown by arrow in FIG. 1, the axes 0 and 0' of the workrolls 2 (only one pair of the workrolls 2 having their axes arranged in one plane perpendicular to the axis of the billet 1, such as shown in FIG. 1) are advanced from the point $0_1$ to the point $0_2$ and from the point $0_1'$ to the point $0_2'$, respectively, and the workrolls 2 are thus caused to rotate clockwise about their axes 0 and 0' (as shown by in full line).

As this happens, the sections "AB" of the working surfaces of the workrolls 2 are brought in contact with the billet 1 during rotation of the workrolls to thereby simultaneously work all four faces of the bilet 1 over the deformation cone "K", i.e. substantially uniformly over the entire perimeter of the billet cross-section, and deformation zones induced by all workrolls 2 are disposed within the length "m" of one deformation zone throughout the reduction period, the deformation zones moving simultaneously over the deformation cone "K" without their relative displacement axially along the billet 1.

The advantages of the rolling method according to the invention have been dealt with hereinabove.

At the end of the operative position of each workroll 2 (as shown with thin lines in FIG. 1), the sizing section "BC" of the working surface of the workroll 2 is positioned in parallel with the axis of the billet 1 to thereby effect sizing of the billet 1.

The reverse advance motion of the roll housing and rotation of the workrolls 2 (idle stroke) is effected in the direction of arrows shown with dotted lines in FIG. 1. At the end of the idle movement, the billet 1 is turned about its axis through a half the angle $\alpha$, i.e. through 45°, and is concurrently axially fed through a step "S" in the direction of the pass line.

This occurs as follows.

After the billet 1 reaches the jaws 26 of the grip 22 within the guide member 20 (FIG. 4), and the end portion of the billet 1 is released from the grip of the feeder device 19, the auxiliary device for axially feeding and tilting the billet 1, mounted on the side of its emergence from the workrolls 2 starts operating. During the right-hand working movement of the rolling housing (as viewed from FIG. 4), the upper jaw 26 of the clamp 22 is in the uppermost position since no pressure is applied to the piston of the pneumatic cylinder means 28 at that time. Therefore, the leading end of the billet 1 freely passes between the jaws 26, and the jaws themselves are caused to move to the left together with the guide member 20 under the action of the linkage 23 including the arms 30, 32, 35 and 36.

Upon completion of the working movement of the roll housing and that of workrolls 2, with the sizing of the next portion of the billet 1 being over and the roll housing starting on its return (idle) movement, the pneumatic cylinder means 28 of the clamp 22 urges the upper jaw 26 against the surface of the billet 1. The guide member 20 thus starts moving to the right as the workrolls 2 start moving apart from the deformation cone "K" of the billet 1 during the idle movement of the roll housing. At the beginning of the idle movement of the roll housing, the billet 1 is still clamped in the nip of the workrolls 2, and the guide member 20 cannot move to the right. At that stage, the rocking motion of the arm 32 causes displacement of the slider 33 and compression of the spring 34.

When the workrolls 2 are backed away from the billet 1 at the end of their working movement, the spring 34 acts to accelerate the rocking motion of the arm 30, as well as that of the guide member 20 to the right, thereby facilitating more rapid completion of the right-hand feeding of the billet 1 clamped in the jaws 26 of the clamp 22. Prior to resuming the step of reducing the billet 1, the jaws 26 are brought apart.

At the beginning of each working movement of the roll housing, pressure is applied to the piston of the pneumatic cylinder means 24 for tilting the billet 1. As the workrolls 2 are backed away from the billet 1, the latter is caused to rotate together with the guide member 20, this rotation being over as the workrolls 2 are brought wide apart at the end of the idle movement of the roll housing.

During the next idle movement of the roll housing, the tilting direction of the billet 1 is oppositely changed, thus preventing the billet 1 from being twisted.

The length of the axial feed step "S" of the billet 1 to the workrolls 2 is adjusted by means of the stop 37 which limits the rocking angle of the arm 30 to the right.

The mill according to the invention is simple in construction and reliable in operation, lending itself readily for carrying out the method of rolling according to the invention.

Operating reliability is the distinguishing feature of the rocking bars 15 which provides for positive rotation of the workrolls 2 in synchronism with the operation of the roll housing, as well as that of the crank drive of the roll housing. Other embodiments of the mill drive may be used in which the reciprocations of the roll housing may be effected by means of simpler devices, such as hydraulic cylinders and linear motors which do not require any transmission.

In the mill according to the invention, the pressure force of the billet 1 applied to the workrolls 2 is not transmitted directly to the mill components and is distributed among the rocking bars 15 and shafts 11 of the driven rolls 2.

The construction of the auxiliary device for axially feeding and tilting the billet 1 provides for passing a part of the billet 1 through the guide member 20 during the reduction induced by the workrolls 2, and enabling the billet 1 to be moved through the axial feed step "S" at the end of the idle movement of the workrolls 2. This device is in a force transmitting connection with the roll housing 5, ensuring their synchroneous operation.

The use of the clamp 22 with a pneumatic drive for clamping the billet 1 ensures smooth application of force at the moment of clamping, as well as during tilting of the billet 1.

It is understood that various modifications may be made in the construction of the mill by those skilled in the art, the construction of the mill being described above as non-limiting example of the invention.

Rolling of billets of low-ductility alloys conducted by the inventors on the mill carrying out the method according to the invention confirmed the above-mentioned advantages of the method and mill and showed them promising for commercial use.

What is claimed is:

1. A mill for rolling metal billets in a single pass comprising: a frame having guides running in parallel with the axis of the billet being worked; a drive mounted on said frame; a roll housing mounted in the guides of said frame and geared to said drive to reciprocate the roll housing inside said guides of said frame; at least four variable-radius workrolls mounted in said roll housing symmetrically with respect to the axis of the billet in such a manner that the geometrical axes of rotation of said workrolls are disposed in one plane perpendicular to the axis of the billet, and said workrolls being rotated about said axes during rolling positively and in synchronism with the reciprocations of the roll housing, each workroll having a section shaped as a sector of a circle in a plane perpendicular to the geometrical axis of its rotation, the axis of the sector being disposed eccentrically relative to said geometrical axis of the workroll rotation so as to define a curvilinear section on the surface thereof having a variable radius of curvature, each workroll having a sizing section on the side of the billet emerging from the workrolls, mating with the curvilinear section, the sizing section being formed in such a manner that all generatrices of its surface run in parallel with the axis of the billet at the end of the working movement of the workroll, the length of the sizing section axially along the billet being determined from the formula $l \geqq S \cdot \lambda$, wherein S is the axial feed of te billet through one step and $\lambda$ is the elongation of the latter; a feeder for axially feeding the billet, mounted on said frame on the side of the billet entry into said workrolls and geared to said drive.

2. A mill according to claim 1, wherein the part of the workroll having the curvilinear and sizing sections is formed with a removable insert of a wear-resistant refractory alloy, the other part of the workroll being fitted with an appropriate recess and a threaded hole for securing said insert thereto by means of a bolt.

3. A mill for rolling billets in a single pass comprising: a frame having guides running in parallel with the axis of the billet being worked; a drive mounted on said frame; a roll housing mounted in the guides of said frame and geared to said drive to reciprocate the roll housing inside said guides of said frame; at least four variable radius workrolls mounted in said roll housing symmetrically with respect to the axis of the billet in such a manner that the geometrical axes of rotation of said workrolls are disposed in one plane perpendicular to the axis of the billet, and said workrolls being rotated about said axes during rolling positively and in synchronism with the reciprocations of the roll housing, the positive rotation of each workroll about its axis being effected by means of a rocking bar having one end articulated to the workroll and the other end articulated to a support member common for all rocking bars and secured to the frame on the side of the billet emergence from the workrolls; a feeder for axially feeding the billet, mounted on said frame oj the side of the billet entry into said workrolls and geared to said drive.

4. A mill according to claim 3 wherein each rocking bar has one end thereof forked to embrace the corresponding workroll at the point of their articulation joint.

5. A mill according to claim 3, wherein the support member is formed of a hollow cylindrical casing mounted coaxially with the billet and having through holes fitted in the end walls thereof coaxial with the billet and receiving a guide member formed as a tube for the passage of the billet, axially movable and rotatable about its axis in the support member together with the billet by means of an auxiliary device for axially feeding and tilting the billet, having a clamp for clamping the billet in the guide member and mounted in openings of the guide member, a linkage adapted to gear the outlet end of the guide member to the roll housing to cause the axial movement of the guide member, and a pneumatic cylinder means having a cylinder pivotally connected to the support member, with a piston rod thereof being pivotally connected to the guide member for rotating the guide member.

6. A mill according to claim 5, wherein the clamp comprises two jaws mounted on either side of the axis of the billet in coaxial guides fitted in the openings of the guide member, one jaw being rigidly secured to a piston rod of another pneumatic cylinder means externally mounted to the guide member, the other jaw being secured to an adjustment screw for adjusting the gap between the jaws.

* * * * *